US012295428B2

(12) United States Patent
Choi

(10) Patent No.: US 12,295,428 B2
(45) Date of Patent: May 13, 2025

(54) STRUCTURE PROVIDED WITH CONCEALED MODULES FOR PREVENTING SEPARATION OF SOCKS

(71) Applicant: Seung-Oug Choi, Gwangju (KR)

(72) Inventor: Seung-Oug Choi, Gwangju (KR)

(73) Assignee: Seung-Oug Choi, Gwangju (KR)

( * ) Notice: Subject to any disclaimer, the term of this patent is extended or adjusted under 35 U.S.C. 154(b) by 0 days.

(21) Appl. No.: 18/264,196

(22) PCT Filed: Jan. 17, 2022

(86) PCT No.: PCT/KR2022/000799
§ 371 (c)(1),
(2) Date: Aug. 3, 2023

(87) PCT Pub. No.: WO2022/169132
PCT Pub. Date: Aug. 11, 2022

(65) Prior Publication Data

US 2024/0122272 A1 Apr. 18, 2024

(30) Foreign Application Priority Data

Feb. 4, 2021 (KR) ..... 20-2021-0000367
Mar. 16, 2021 (KR) ..... 10-2021-0034597

(51) Int. Cl.
*A41B 11/00* (2006.01)
*D06F 95/00* (2006.01)

(52) U.S. Cl.
CPC ..... *A41B 11/002* (2013.01); *D06F 95/008* (2013.01); *A41B 2500/50* (2013.01)

(58) Field of Classification Search
CPC ..... A41B 11/002; A41B 2300/24; A41B 2500/50; D06F 95/008; A44B 1/04; A44B 1/12
See application file for complete search history.

(56) References Cited

U.S. PATENT DOCUMENTS 5,038,413 A * 8/1991 Ursino ..... A41B 11/002 24/113 MP
5,490,309 A * 2/1996 Velasquez ..... A44B 17/0035 24/104

(Continued)

FOREIGN PATENT DOCUMENTS

FR 2730391 A1 * 8/1996 ..... A41B 11/002
JP 2006-104699 A 4/2006

(Continued)

OTHER PUBLICATIONS

International Search Report for International Application No. PCT/KR2022/000799, mailed Apr. 20, 2022, 5 pages with English Translation.

(Continued)

*Primary Examiner* — Alissa L Hoey
(74) *Attorney, Agent, or Firm* — TraskBritt

(57) ABSTRACT

A structure includes female and male snap buttons are supported so as to be covered by left and right concealed modules fixed to one side of two socks, respectively. Thus, when the socks are not being worn, the female and male snap buttons can be exposed by an opening operation of the concealed modules to correspondingly couple the two socks to each other so that the two socks form a pair when washed, dried, and stored. When the socks are being worn, the female and male snap buttons can be covered so as not to be exposed to the outside by a closing operation of the concealed modules. Thus, it is possible to prevent protrusions of the female and male snap buttons from contacting skin and clothing on the opposite ankle.

13 Claims, 4 Drawing Sheets

(56) References Cited

U.S. PATENT DOCUMENTS

| | | | | |
|---|---|---|---|---|
| 5,926,925 | A * | 7/1999 | Hicks | A41B 11/002 24/303 |
| 6,161,263 | A * | 12/2000 | Anderson | A41B 11/002 24/30.5 S |
| 6,185,751 | B1 * | 2/2001 | Mason | D06F 95/008 2/239 |
| 6,826,812 | B2 * | 12/2004 | Lo | A41B 11/002 24/701 |
| 7,302,712 | B2 * | 12/2007 | Abrusia | A44B 11/2592 2/244 |
| 8,132,433 | B2 * | 3/2012 | Andersen | A44B 1/14 24/113 MP |
| 8,359,671 | B1 | 1/2013 | Glass et al. | |
| 9,844,245 | B1 * | 12/2017 | Naylor | A44B 1/14 |
| 10,485,307 | B2 * | 11/2019 | Linn | A44B 17/0023 |
| 10,633,787 | B1 * | 4/2020 | Pham | D06F 95/008 |
| 2005/0262615 | A1 | 12/2005 | Pietzyk-Hardy | |
| 2008/0034478 | A1 * | 2/2008 | Patterson | A41B 11/002 2/239 |
| 2008/0222778 | A1 * | 9/2008 | Dierssen-Morice | D06F 95/008 2/243.1 |
| 2010/0011486 | A1 | 1/2010 | Allen | |
| 2011/0209268 | A1 * | 9/2011 | Smitherman | A41B 11/002 2/266 |
| 2012/0167276 | A1 * | 7/2012 | Brosie | D06F 95/008 2/239 |
| 2012/0240304 | A1 * | 9/2012 | LoVerde | D06F 95/008 2/69 |
| 2014/0090149 | A1 * | 4/2014 | Zuiderveen | A41B 11/002 2/239 |
| 2016/0270453 | A1 * | 9/2016 | Barrett | A41B 11/002 |
| 2020/0024834 | A1 | 1/2020 | Park et al. | |
| 2022/0279863 | A1 * | 9/2022 | Ferguson | A41B 11/002 |

FOREIGN PATENT DOCUMENTS

| | | | |
|---|---|---|---|
| JP | 2006-118298 | A | 5/2006 |
| KR | 20-0234599 | Y1 | 9/2001 |
| KR | 20-0256248 | Y1 | 12/2001 |
| KR | 20-0444016 | Y1 | 4/2009 |
| KR | 10-2014-0111776 | A | 9/2014 |
| KR | 10-2014-0111777 | A | 9/2014 |
| KR | 10-2018-0054995 | A | 5/2018 |
| KR | 20-2022-0001658 | U | 7/2022 |

OTHER PUBLICATIONS

International Written Opinion for International Application No. PCT/KR2022/000799, mailed Apr. 20, 2022, 6 pages with English Machine Translation.

Korean Notice of Reasons for Rejection for Korean Application No. 10-2021-0034597, dated Dec. 19, 2022, 07 pages with English translation.

Korean Request for the Submission of an Opinion received for Korean Patent Application No. 10-2021-0034597, mailed on Dec. 30, 2022, 5 pages With English Translations.

Korean Written Decision on Registration received for Korean Patent Application No. 10-2021-0034597, mailed on Jan. 19, 2023, 6 pages With English Translations.

Korean Written Decision on Registration received for Korean Patent Application No. 20-2021-0000367, mailed on May 31, 2022, 4 pages With English Translations.

* cited by examiner

STRUCTURE PROVIDED WITH CONCEALED MODULES FOR PREVENTING SEPARATION OF SOCKS

CROSS-REFERENCE TO RELATED APPLICATIONS

This application is a national phase entry under 35 U.S.C. § 371 of International Patent Application PCT/KR2022/000799, filed Jan. 17, 2022, designating the United States of America and published as International Patent Publication WO 2022/169132 A1 on Aug. 11, 2022, which claims the benefit under Article 8 of the Patent Cooperation Treaty of Korean Patent Application Serial No. 20-2021-0000367, filed Feb. 4, 2021 and Korean Patent Application Ser. No. 10-2021-0034597, filed Mar. 16, 2021.

TECHNICAL FIELD

The disclosure relates to a structure provided with concealed modules for preventing separation of socks, and more particularly to a structure provided with concealed modules for preventing separation of socks to reveal or conceal female and male snap fasteners attached to one side of each of two socks so that a pair of socks can be coupled to or separated from each other.

BACKGROUND

In general, two socks are paired, and both of them are used at the same time due to the structure of a human body.

Such socks are usually changed every day, and the number of socks to wash is very large in a household with multiple people living together. The large number of socks are likely to get tangled, and it is difficult to pair the socks among the tangled socks. Therefore, it is necessary to compare and match the socks one by one.

Further, it is very difficult to distinguish between old and new socks having the same design and color, and thus the socks may be mixed and mismatched. In addition, it is also cumbersome to pair and fold the washed socks several times even when the washed socks are stored.

Accordingly, there has conventionally been proposed Korean Utility Model No. 20-0234599 titled "SOCKS WITH COUPLER," in which opposite couplers are respectively attached to ankle portions of two socks, and the couplers are formed by a snap fastener or a Velcro tape.

However, the snap fasteners of the conventional couplers respectively attached to the ankle portions of the two socks and facing each other are provided in the form of female and male snap fasteners that always protrude outwards from the ankle portion of the two socks, and therefore T-shaped protrusions formed in the female and male snap fasteners may touch the skin of an opposite ankle to cause abrasions or touch clothing to cause lint while wearing the socks, thereby causing problems of remarkably lowering the marketability such as damaging the aesthetics of the socks.

BRIEF SUMMARY

The disclosure is conceived to solve the problems of the related art, and an aspect of the disclosure is to provide a structure provided with concealed modules for preventing separation of socks, in which T-shaped protrusions formed in female and male snap fasteners are prevented from touching skin or clothing and the aesthetics and marketability of the socks are enhanced.

According to an embodiment of the disclosure, a structure provided with concealed modules for preventing separation of socks, includes: left and right concealment modules respectively attached to sides of two socks and formed with entrances opened or closed at sides; and female and male snap fasteners respectively attached to centers of the left and right concealment modules, revealed upon opening the entrances of the left and right concealment modules, and engaged with each other to pair the two socks.

According to an alternative embodiment, a pair of pockets may be formed to be concavely recessed or convexly protrude having a semilunar shape to attach the left and right concealment modules at the sides of the two socks.

According to an alternative embodiment, the pair of pockets may be formed in a region between an ankle bone corresponding portion and a heel corresponding portion on the sides of the two socks.

According to an alternative embodiment, the left and right concealment modules may include a silicone material.

According to an alternative embodiment, the left and right concealment modules may be attached to positions corresponding to the areas of the pair of pockets by an attachment band.

According to an alternative embodiment, the left and right concealment modules may include meniscus-shaped caps that support the female and male snap fasteners respectively attached to centers thereof and facing outwards, are respectively inserted in the pair of pockets from the outsides of the two socks; thin-film covers that extend inwards from peripheral edges of the caps and interlock with transformation of the caps to reveal or conceal the female and male snap fasteners supported on the caps; and rims that extend outwards from edges where the caps and the covers meet and are formed with multiple through holes so as to be contacted to the surface of the edges of sock surfaces (or outer sides) forming boundaries with the pair of pockets.

According to an alternative embodiment, the cap may be formed having a cross-sectional thickness decreasing from the center toward the edge to be easily transformed by a pressing force to have an inwardly concave or outwardly convex shape.

According to an alternative embodiment, the cover may be formed extending from the edge of the cap and having a certain thickness and is divided into multiple equal parts to open or close the entrance.

According to an alternative embodiment, the multiple through holes may be formed at regular intervals along a circumferential direction of the rim.

According to an alternative embodiment, the attachment band may include an adhesive applied to a rear surface thereof to be adhered corresponding to an area of the rim and partially adhered to the edge of the sock surface (or outer side) forming a boundary with the pair of pockets through the multiple through holes.

In a structure according to the disclosure, female and male snap fasteners are supported to be covered with left and right concealment modules respectively attached to one sides of two socks, so that the female and male snap fasteners can be revealed and engaged by opening the concealment modules to pair the two socks during washing, drying, and storing in the case of not wearing the socks, and the female and male snap fasteners can be concealed and covered by closing the concealment modules made of a silicone material to prevent T-shaped protrusions formed in female and male snap fasteners from touching skin or clothing of an opposite ankle with each other, in particular, to prevent the T-shaped protrusions formed in the female and male snap fasteners from touching the skin and causing abrasions or touching the clothing and causing lint in the case of wearing the socks, thereby having advantages of improving the marketability by preventing damage to the aesthetics of the socks.

DETAILED DESCRIPTION

Below, embodiments of the disclosure will be described with reference to the accompanying drawings, FIGS. 1 to 5, for full understanding of the disclosure. The embodiments of the disclosure may be modified in various ways, and should not be construed as limiting the scope of the disclosure. Accordingly, the shape and the like of elements in the accompanying drawings may be exaggerated to emphasize the clarity of description. It should be noted that like numerals refer to like elements throughout the accompanying drawings. The detailed descriptions about publicly known functions and configurations that would unnecessarily obscure the subject matters of the disclosure are omitted.

Figure 1A:
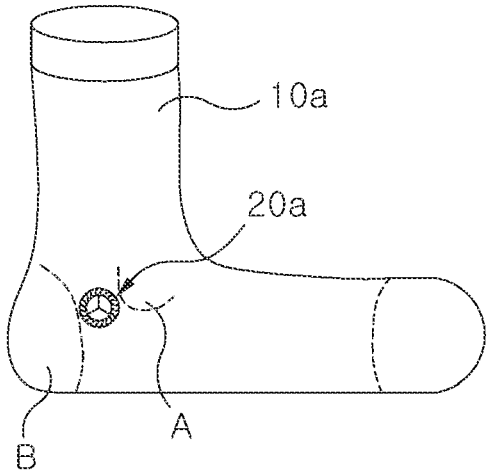
FIGS. 1A and 1B illustrate a structure provided with concealed modules for preventing separation of socks according to the disclosure attached to each of two socks.
Figure 1B:
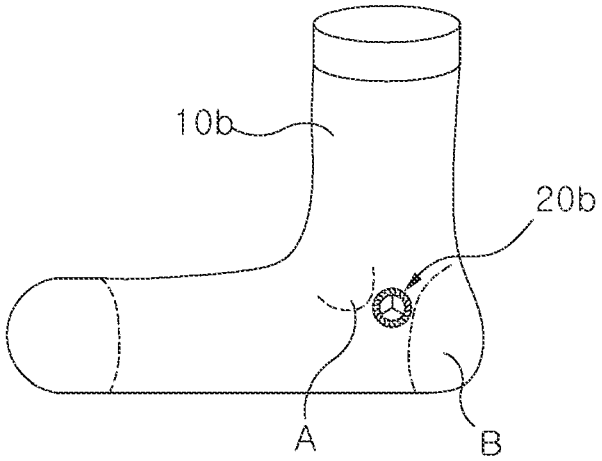
Figure 2A:
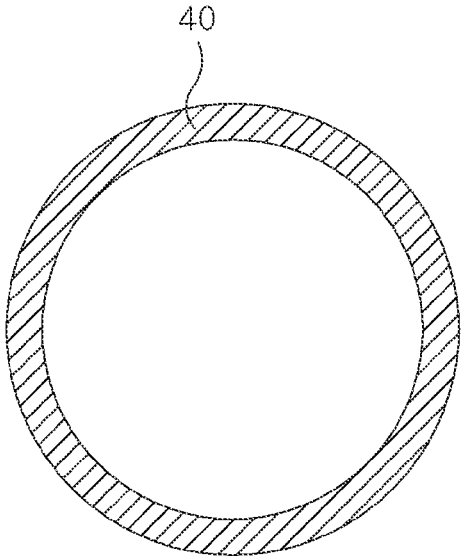
FIGS. 2A and 2B are front views of a structure provided with concealed modules for preventing separation of socks according to the disclosure.
Figure 2B:
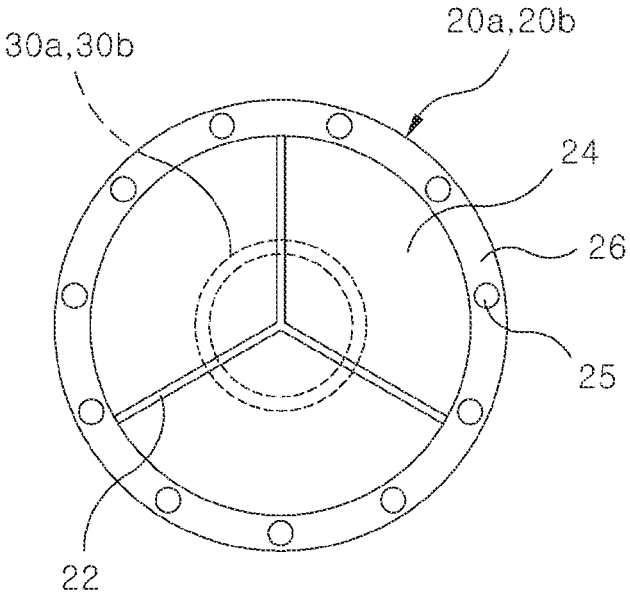
Figure 3A:
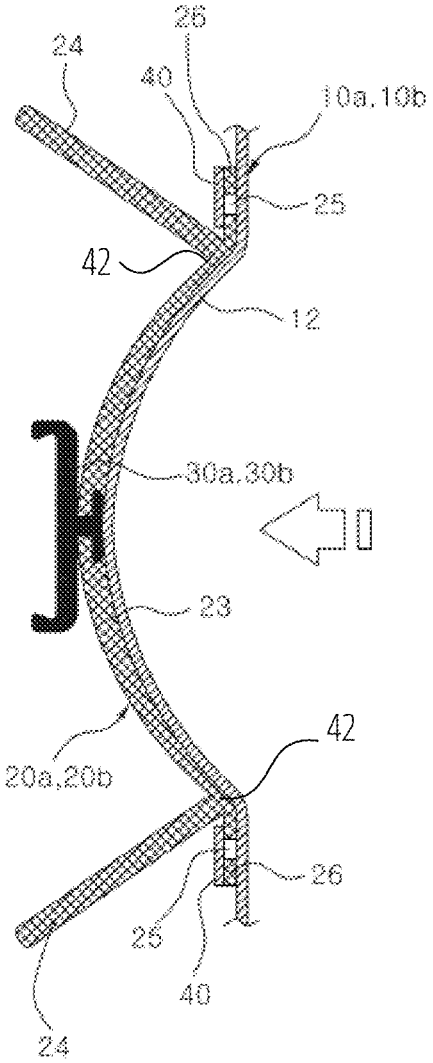
FIGS. 3A and 3B are longitudinal section views showing operations of a structure provided with concealed modules for preventing separation of socks according to the disclosure.
Figure 3B:
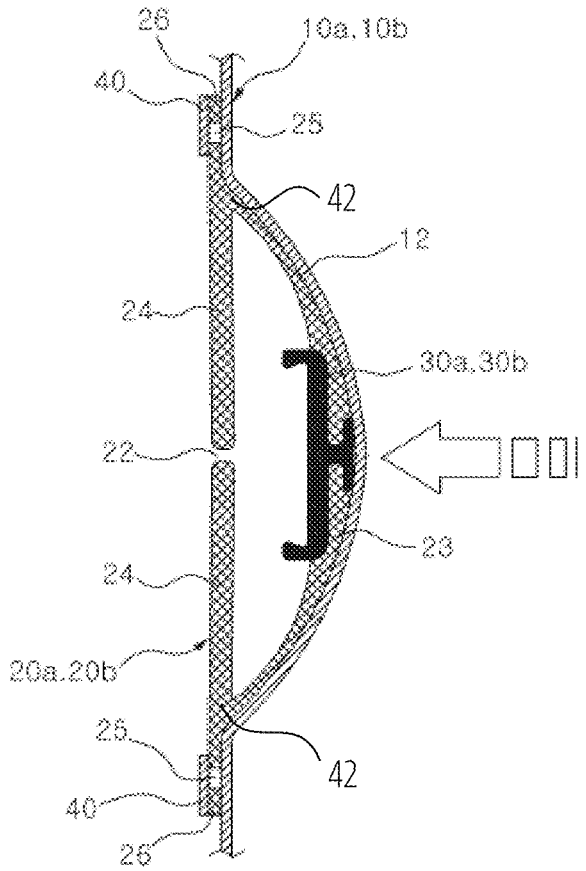
Figure 4:
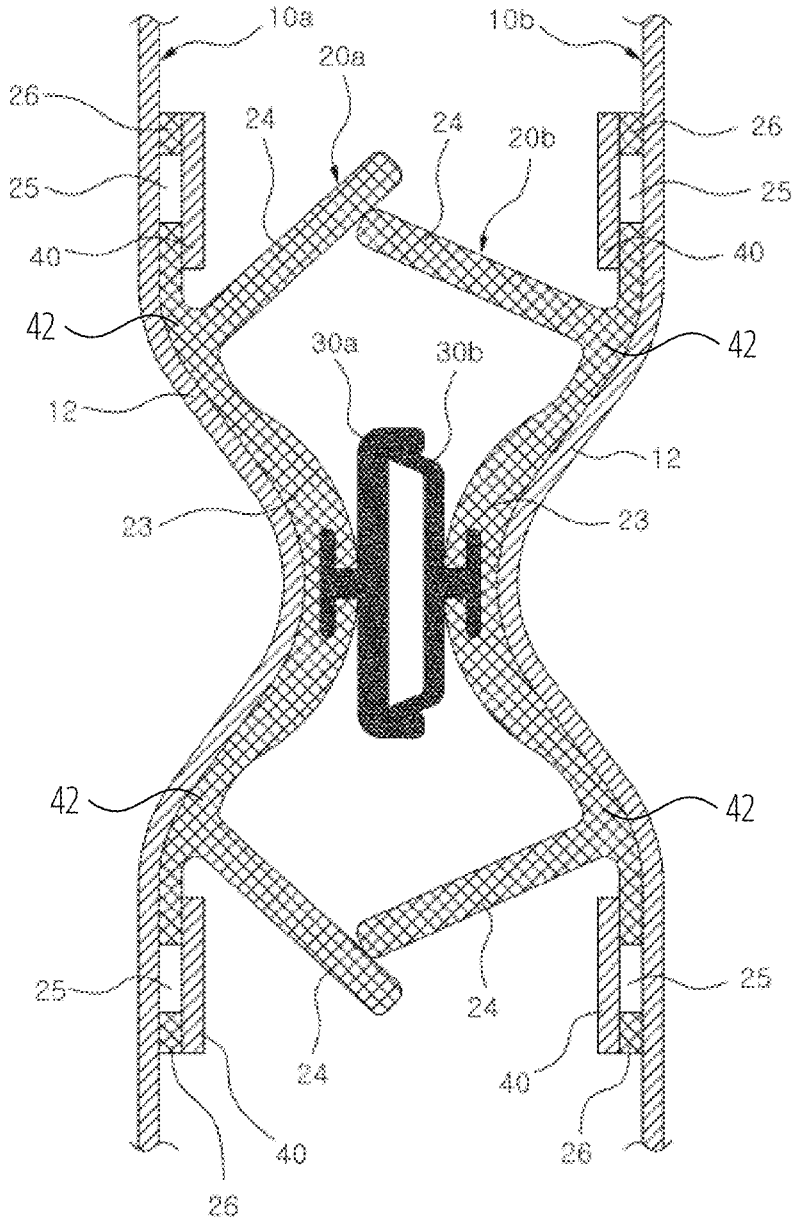
FIG. 4 is a longitudinal section view showing that two socks are coupled by a structure provided with concealed modules for preventing separation of socks according to the disclosure.
Figure 5A:
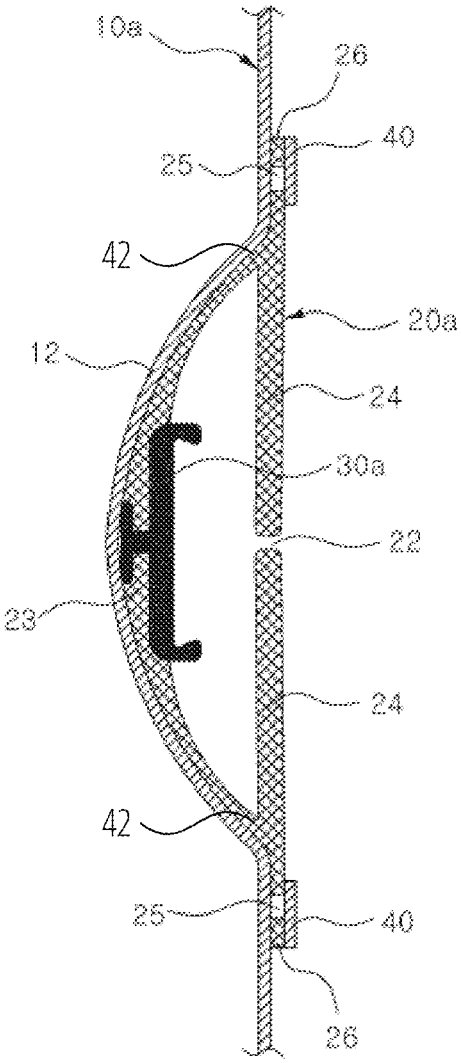
FIGS. 5A and 5B are longitudinal section views showing a concealed state of two separated socks in a structure provided with concealed modules for preventing separation of socks according to the disclosure.
Figure 5B:
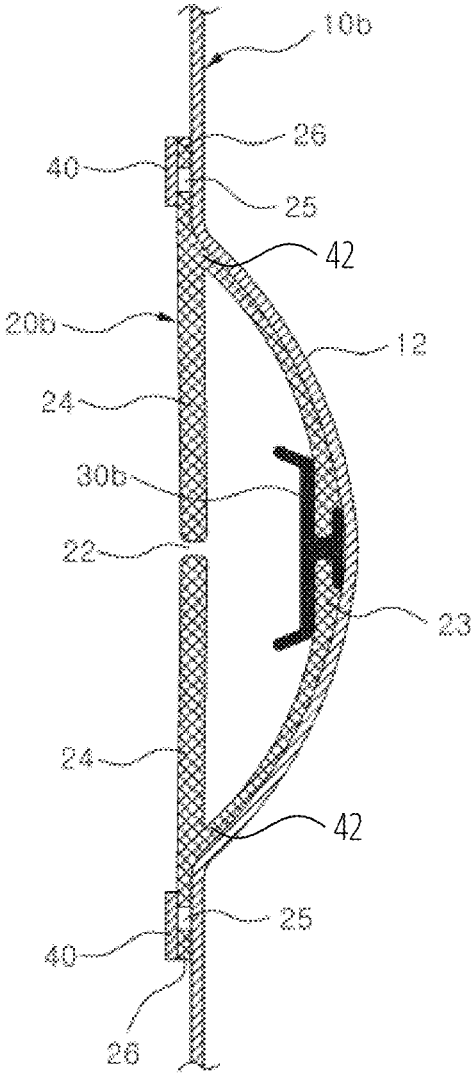

FIGS. 1A and 1B illustrate that a structure provided with concealed modules for preventing separation of socks according to the disclosure is attached to each of two socks, FIGS. 2A and 2B are front views of a structure provided with concealed modules for preventing separation of socks according to the disclosure, FIGS. 3A and 3B are longitudinal section views showing operations of structure provided with concealed modules for preventing separation of socks according to the disclosure, FIG. 4 is a longitudinal section view showing that two socks are coupled by a structure provided with concealed modules for preventing separation of socks according to the disclosure, and FIGS. 5A and 5B are longitudinal section views showing a concealed state of two separated socks in a structure provided with concealed modules for preventing separation of socks according to the disclosure.

Referring to FIGS. 1 to 5, a structure provided with concealed modules for preventing separation of socks according to the disclosure includes left and right concealment modules 20*a* and 20*b* respectively attached to sides of two socks 10*a* and 10*b* and formed with entrances 22 opened or closed at the sides; and female and male snap fasteners 30*a* and 30*b* respectively attached to the centers of the left and right concealment modules 20*a* and 20*b*, revealed when the entrances 22 of the left and right concealment modules 20*a* and 20*b* are opened, and engaged with each other so that the two socks 10*a* and 10*b* can be paired.

In other words, a pair of pockets 12 are formed at the sides of the two socks 10*a* and 10*b* to be concavely recessed or convexly protrude having a semilunar shape so that the left and right concealment modules 20*a* and 20*b* can be attached to the surfaces (or outer sides) of the socks. The pair of pockets 12 are formed in a region between an ankle bone corresponding portion A and a heel corresponding portion B on sides of the two socks 10*a* and 10*b* during a sock knitting process, respectively, thereby minimizing the protrusion of the bulky left and right concealment modules 20*a* and 20*b* from the surfaces (or outer sides) of the socks.

The left and right concealment modules 20*a* and 20*b* are disposed corresponding to the areas of the pair of pockets 12, and injection-molded with a silicone material to be attached to the sock surface (or outer side) by an annular attachment band 40.

In other words, the left and right concealment modules 20*a* and 20*b* include meniscus-shaped caps 23 that support the female and male snap fasteners 30*a* and 30*b* respectively attached to the centers thereof and facing outwards, are respectively inserted in the pair of pockets 12 from the outsides of the two socks 10*a* and 10*b* and transformed to have an inwardly concave or outwardly convex shape; thin-film covers 24 that extend inwards from the peripheral edges 42 of the caps 23 and interlock with the transformation of the caps 23 to reveal or conceal the female and male snap fasteners 30*a* and 30*b* supported on the caps 23; and rims 26 that extend outwards from the edges 42 where the caps 23 and the covers 24 meet and are formed with multiple through holes 25 so as to be contacted to the surface of the edges of the sock surfaces (or outer sides) forming boundaries with the pair of pockets 12.

In this case, the cap 23 is formed having a cross-sectional thickness decreasing from the center toward the edge 42 so as to be easily transformed by a pressing force to have the inwardly concave or outwardly convex shape.

The cover 24 is formed extending from the edge 42 of the cap 23 and having a certain thickness and is divided into three or multiple equal parts to open or close the entrance 22.

The multiple through holes 25 are formed at regular intervals along a circumferential direction of the rim 26, and are shaped like circles.

The rim 26 is shaped like a circular band corresponding to the area of the attachment band 40.

The attachment band 40 has an adhesive applied to the rear surface thereof to be adhered corresponding to the area of the rim 26 and partially adhered to the edge of the sock surface (or outer side) forming the boundary with the pockets 12 through the multiple through holes 25 so that the left and right concealment modules 20*a* and 20*b* can be attached to the pair of pockets 12 of the two socks 10*a* and 10*b*.

With this configuration according to the disclosure, in order to pair the two socks 10*a* and 10*b* by the left concealment module 20*a* or the right concealment module 20*b*, each of which is attached to the pocket 12 formed between the ankle bone corresponding portion A and the heel corresponding portion B of each of the two socks 10*a* and 10*b* as shown in FIGS. 1A and 1B, the rear of the cap 23 of the left concealment module 20*a* or the right concealment module 20*b* is first pressed in the direction of the arrow from the state shown in FIG. 3B, and thus the cover 24 integrally formed on the edge 42 of the cap 23 is radially spread while the meniscus cap 23 is transformed having an outwardly convex shape as shown in FIG. 3A, thereby opening the entrance 22 and at the same time revealing the female snap fastener 30*a* or the male snap fastener 30*b* supported at the center of the cap 23 as moved forward a certain distance according to the transformation of the cap 23.

In this state, the two socks 10*a* and 10*b* are moved close to each other in corresponding shape and at the same time the female snap fastener 30*a* and the male snap fastener 30*b* are engaged with each other as shown in FIG. 4, thereby connecting the two socks 10*a* and 10*b* as a single pair. Therefore, the two socks 10*a* and 10*b* are not separated during washing, drying and storing, thereby having advantages of avoiding the hassle and inconvenience of matching and searching for the two socks 10*a* and 10*b*.

On the other hand, in order to separate and wear the two socks 10*a* and 10*b*, the cap 23 of the left concealment module 20*a* or the right concealment module 20*b* is pressed inwards and transformed to have an inwardly concave shape from the state shown in FIG. 3A to the state shown in FIG. 3B, and thus the cover 24 integrally formed on the edge 42 of the cap 23 is folded toward the center of the cap 23 according to the transformation of the cap 23, thereby closing the entrance 22 and concealing the female snap fastener 30*a* or the male snap fastener 30*b* supported at the center of the cap 23.

In other words, when the entrances 22 of the left concealment module 20*a* and the right concealment module 20*b* attached to the pockets 12 of the two socks 10*a* and 10*b* are closed as shown in FIGS. 5A and 5B, the female and male snap fasteners 30*a* and 30*b* are respectively covered with and concealed by the covers 24 of the left and right concealment modules 20*a* and 20*b*, thereby having advantages of preventing abrasions that may occur in the skin of an opposite ankle, lint that may occur in clothing, and the like caused by contact with T-shaped protrusions formed in the female and male snap fasteners 30*a* and 30*b*.

Further, the left and right concealment modules 20*a* and 20*b* are injection-molded with the silicone material inserted in and attached to the meniscus-shaped pockets 12 formed in the regions between the ankle bone corresponding portion A and the heel corresponding portion B at the height where an ankle bone of a human body protrudes, thereby having advantages of minimizing the bulkiness due to the installation area of the left and right concealment modules 20*a* and 20*b* and soft and causing no irritation and no incompatibility with skin due to the softness and composition of the silicone material.

Meanwhile, the disclosure is not limited to the foregoing embodiments but may be modified and altered without departing from the scope of the disclosure, and the technical ideas subjected to such modification and alteration should also be considered to fall within the scope of the accompanying claims.

DESCRIPTION OF REFERENCE NUMERALS

10*a*, 10*b*: two socks
12: pocket
20*a*, 20*b*: left and right concealment modules
22: entrance
23: cap
24: cover
25: multiple through holes
26: rim
30*a*, 30*b*: female and male snap fasteners
40: attachment band
A: ankle bone corresponding portion
B: heel corresponding portion

The invention claimed is:

1. A structure provided with concealed modules for preventing separation of socks, comprising:
- left and right concealment modules respectively attached to sides of two socks and having entrances opened or closed at sides;
- female and male snap fasteners respectively attached to centers of the left and right concealment modules, revealed upon opening the entrances of the left and right concealment modules, and engaged with each other to pair the two socks;
- a pair of concavely recessed or convexly protruding pockets having a semilunar shape, the pockets disposed within the concealment modules; and
- wherein each of the left and right concealment modules comprise:
  - an attachment band extending around a peripheral edge of the concealment modules;
  - a meniscus-shaped cap supporting the female or male snap fastener respectively attached to a center of the female or male snap fastener and facing outwards, the meniscus-shaped cap respectively disposed within the pocket;
  - thin-film covers extending inwards from and integral with peripheral edges of the cap, transformation of the cap revealing or concealing the female or male snap fastener supported on the cap; and
  - a rim extending outwards from the peripheral edge of the cap, the rim having multiple through holes extending through the rim to enable contact with surfaces of the socks through the multiple through holes.

2. The structure of claim 1, wherein the pair of pockets are formed in a region between an ankle bone corresponding portion and a heel corresponding portion of each of the two socks.

3. The structure of claim 1, wherein the left and right concealment modules comprise a silicone material.

4. The structure of claim 1, wherein the cap has a cross-sectional thickness decreasing from the center toward the edge so as to enable transformation of the cap by a pressing force to have an inwardly concave or outwardly convex shape.

5. The structure of claim 1, wherein the covers have a thickness, the covers divided into multiple equal parts to open or close the entrance.

6. The structure of claim 1, wherein the multiple through holes are located at regular intervals along a circumference of the rim.

7. The structure of claim 1, wherein the attachment band comprises an adhesive applied to a rear surface thereof to be adhered to an area of the rim and partially adhered to the surfaces of the socks through the multiple through holes.

8. A pair of socks, comprising:
- a first sock;
- a second sock; and
- a first fastener attached to a surface of the first sock; and
- a second fastener attached to a surface of the second sock;
- wherein, the first fastener and the second fastener are configured to releasably attach to one another; and
- wherein each of the first fastener and the second fastener respectively comprises:
  - a deformable concealment module having a pocket therein, the pocket being openable and closeable responsive to manual deformation of the concealment module; and a fastening member attached to the concealment module within the pocket, the fastening member being revealed upon opening the pocket, the fastening member being hidden upon closing the pocket, wherein the deformable concealment module has a concave shape in a closed configuration of the deformable concealment module, and a convex shape in an open configuration of the deformable concealment module, wherein each of the first fastener and the second fastener comprises an attachment band extending around a peripheral edge of the deformable concealment module, and wherein the deformable concealment module comprises:

a cap;

a cover extending inwards from a peripheral edge of the cap so as to define the pocket between the cap and the cover, deformation of the cap causing movement of the cover to reveal or conceal the fastening member within the pocket; and a rim extending outwards from the peripheral edge of the cap, the rim having multiple through holes extending through the rim to enable contact with surfaces of the socks through the multiple through holes, wherein the cap has a cross-sectional thickness decreasing from the center toward the peripheral edge of the cap so as to enable manual deformation of the cap by a pressing force to cause the cap to have an inwardly concave shape or an outwardly convex shape.

9. The pair of socks of claim 8, wherein the pocket of the first fastener and the pocket of the second fastener are formed in a region between an ankle bone corresponding portion and a heel corresponding portion of each of the first sock and the second sock.

10. The pair of socks of claim 8, wherein the concealment module comprises silicone.

11. The pair of socks of claim 8, wherein the cover includes multiple divided parts.

12. The pair of socks of claim 8, wherein the multiple through holes are located at regular intervals along the rim.

13. The pair of socks of claim 8, wherein the attachment band comprises an adhesive applied to a surface thereof, the adhesive securing the attachment band to the rim at an interface between the rim and the attachment band, the adhesive securing the respective fastener to the respective sock at an interface between the attachment band and the respective sock within the multiple through holes in the rim.

* * * * *